US009625201B2

(12) United States Patent
Schoonen

(10) Patent No.: US 9,625,201 B2
(45) Date of Patent: Apr. 18, 2017

(54) DEVICE FOR COOLING OR FROSTING A CONTAINER

(71) Applicant: Franke Technology and Trademark Ltd, Hergiswil (CH)

(72) Inventor: Wilhelmus Franciscus Schoonen, BA Son (NL)

(73) Assignee: Franke Technology and Trademark Ltd, Hargiswil (CH)

( * ) Notice: Subject to any disclaimer, the term of this patent is extended or adjusted under 35 U.S.C. 154(b) by 3 days.

(21) Appl. No.: 14/787,126

(22) PCT Filed: Apr. 17, 2014

(86) PCT No.: PCT/EP2014/057894
§ 371 (c)(1),
(2) Date: Oct. 26, 2015

(87) PCT Pub. No.: WO2014/173807
PCT Pub. Date: Oct. 30, 2014

(65) Prior Publication Data

US 2016/0109171 A1 Apr. 21, 2016

(30) Foreign Application Priority Data

Apr. 25, 2013 (EP) ..... 13165361

(51) Int. Cl.
*F25D 31/00* (2006.01)
*F25D 17/06* (2006.01)
*F25B 21/02* (2006.01)

(52) U.S. Cl.
CPC ..... *F25D 17/06* (2013.01); *F25B 21/02* (2013.01); *F25D 31/008* (2013.01)

(58) Field of Classification Search
CPC ..... F25D 2303/0841; F25D 31/008
See application file for complete search history.

(56) References Cited

U.S. PATENT DOCUMENTS 2,959,941 A * 11/1960 McDonald ..... F25D 31/008 62/457.2
3,170,309 A * 2/1965 Federighi ..... F25D 17/06 62/379

(Continued)

FOREIGN PATENT DOCUMENTS

| | | |
|---|---|---|
| EP | 2006620 | 12/2008 |
| GB | 2474352 | 4/2011 |

*Primary Examiner* — Cassey D Bauer
(74) *Attorney, Agent, or Firm* — Volpe and Koenig, P.C.

(57) ABSTRACT

The invention relates to a device (1) for cooling or frosting at least one container (2), in particular a glass or mug, by means of cold air, the device (1) comprising a base (4) with a container receiving portion (3), at least one air inlet (5) and an annular chamber (7), whereby the container receiving portion (3) is comprised with the at least one air inlet (5) through which cold air may be introduced into the annular chamber (7), wherein the container receiving portion (3) comprises an air outlet portion (10) comprising a pipe (9) extending upwards into the at least one container (2), the pipe (9) being configured to suck the air out of the at least one container (2). The at least one air inlet (5) is positioned at an outer circumference of the annular chamber (7) so as to introduce the air into the annular chamber (7) tangentially, thereby generating a swirling upward air flow which is led as a thin layer along the inner surface of the at least one container (2) being placed on the container receiving portion (3), thereby cooling or frosting the container (2).

14 Claims, 11 Drawing Sheets

(56) References Cited

U.S. PATENT DOCUMENTS

| | | | | | |
|---|---|---|---|---|---|
| 3,407,624 | A | * | 10/1968 | Taylor | B65D 83/28 222/402.13 |
| 3,431,749 | A | * | 3/1969 | Morris | F25D 7/00 222/402.13 |
| 3,462,967 | A | | 8/1969 | Prasnikar | |
| 5,111,664 | A | | 5/1992 | Yang | |
| 5,718,124 | A | * | 2/1998 | Senecal | A47F 3/0443 62/3.6 |
| 6,295,820 | B1 | | 10/2001 | Cauchy et al. | |

* cited by examiner

DEVICE FOR COOLING OR FROSTING A CONTAINER

BACKGROUND

The invention relates to a device for cooling or frosting at least one container, in particular a drinking glass or mug.

Some beverages, such as cocktails or beer, are preferably served in cold or frosted drinking glasses so as to on the one hand keep the liquid inside the glass cold and on the other hand to achieve appealing appearance which especially in the case of serving cocktails is a rather important factor.

Thus, in prior art, many devices for chilling or frosting drinking glasses are known. Usually, the glass is placed on a platform of such a device and is cooled down to the desired temperature by treating its outer or inner surface with a chilling agent or refrigerant, such as, for example CO2 or liquid nitrogen or the like. However, due to environmental issues, in the past years the use of such refrigerants, especially of CO2, has become rather problematic.

SUMMARY

Therefore, the present invention is based on the object to provide a device for cooling or frosting a container, such as a drinking glass or mug, which avoids the use of harmful or hazardous refrigerants for the cooling process.

This object is solved by a device for cooling or chilling at least one container having the features according to the invention. Preferred embodiments are defined in the dependent claims.

According to the present invention, a device for cooling or frosting at least one container, in particular a glass or mug, by means of cold air is provided, the device comprising a base with a container receiving portion, at least one air inlet and an annular chamber, whereby the container receiving portion is comprised with the at least one air inlet through which cold air may be introduced into the annular chamber, wherein the container receiving portion comprises an air outlet portion comprising a pipe extending upwards into the at least one container, the pipe being configured to suck the air out of the at least one container, wherein the at least one air inlet is positioned at an outer circumference of the annular chamber so as to introduce the air into the annular chamber tangentially, thereby generating a swirling upward air flow which is led as a thin layer along the inner surface of the at least one container being placed on the container receiving portion, thereby cooling or frosting the container.

By using the ambient air as a refrigerant or cooling agent, a glass or mug may be chilled or frosted in an environmentally compatible manner. The glass or mug is cooled from the inside to avoid an external (warm) air intake. Also, the use of ambient air as a cooling agent is more economical so that the device may be operated in cost-efficient manner.

The at least one air inlet is positioned at the outer circumference of the annular chamber so as to introduce the air into the annular chamber tangentially. Thereby, a swirling effect is generated efficiently and by the centrifugal force with which the air is forced through the container to be cooled, an optimal heat exchange can take place. Moreover, the tangentially swirling upward air flow which due to the so-called Coanda effect is led as a thin layer along the inner surface of the glass lowers the temperature of entire inner surface of the glass or mug very efficiently and with little energy consumption. A very low temperature of the container placed on the device can be achieved immediately after placing the container on the device.

Preferably, the air is sucked out of the at least one container by means of a support fan. This ensures that sufficient air circulation is maintained inside the container and that the desired Coanda effect is obtained at all times.

According to a preferred embodiment, the device further comprises a cooler block in which the air is cooled down to a predetermined temperature, wherein the predetermined temperature is lower than −10° C., preferably between −20° C. and −25° C. Thereby, a strong cooling effect of air as cooling means is achieved.

According to a further preferred embodiment, two air inlets are arranged at the outer circumference of the annular chamber being positioned on opposite sides with an angle of approximately 180° therebetween. However, also other configurations are conceivable, e.g., there may be provided three air inlets at the outer circumference of the annular chamber spaced apart from each other with an angle of 120°.

According to still a further embodiment, each of the two air inlets is equipped with a fan to introduce the cold air with high speed, wherein a swirling effect is generated in the cold air introduced into the annular chamber and the at least one container. The fans which introduce the cold air with high speed into the annular chamber efficiently produce the swirling effect in the air flow and the effectiveness of the device for cooling or frosting at least one container strongly depends on the amount of air and the speed of the air that is led through the glass, since the swirling motion of the cold air flow provides for maximum contact to the inner surface of the container, i.e., the glass or mug.

Moreover, it is advantageous if each fan is equipped with an external engine since the heat generated by the engines during operation may thus be kept out of the cold air channel, i.e., the annular chamber.

Preferably, the cooler block has an air inlet which is connected to the air outlet portion of the container receiving portion, and has at least one air outlet which is connected to the at least one air inlet of the container receiving portion. By this configuration, a compact closed system with a continuous air flow is achieved which is more efficient than an open system since the air is reused and continuously cooled, whereby about 80% the cooler block constitutes about 80% of the closed air circuit. Also, the closed system avoids moisture on the cooler block from relative warm ambient air.

It is also advantageous to lead the air introduced from the pipe into the cooler block through the latter along its longitudinal direction.

Further, the cooler block may be divided into multiple sections though which the air introduced from the pipe is led such that it passes through the cooler block multiple times. This provides for efficient cooling and a high temperature difference ($\Delta T$) of about 30° C. between the air inlet of the cooler block and the air outlets of the latter can be achieved which is optimal for efficient chilling or frosting of a container in the above described manner.

Moreover, the container receiving portion may advantageously comprise illumination means, in particular at least one LED which enhances the visual effect of the freezing or frosting of the container.

According to a further preferred embodiment, the container receiving portion comprises a sensor, in particular an ultra sonic sensor, configured to detect the placement of the at least one container in the container receiving portion.

The detection of the at least one container placed on the container receiving portion may preferably trigger the start of the device automatically to cool or freeze the at least one container. Also, according to a further embodiment, the device may be kept in a standby modus with no container placed in the glass receiving portion and in which a small flow of air is maintained. Thereby, the air temperature in the system of the device will be maintained rather low and the device will be ready to start directly after placing a container in the glass receiving portion.

Preferably, the cooler block comprises an evaporator which is mechanically cooled by an external cooling device or which is thermoelectrically cooled by a Peltier element.

The device may be configured as an integrated device, a standalone device or a mobile device.

Also, the device may be configured as a single glass cooler or freezer or as a multiple glass cooler or freezer.

It has to be added that the pipe in the container can be used to blow the air into the container, the return of the air will than flow at the outside of the pipe to the chamber below. In that way, even it will take more time it is possible to freeze the glass in this method as well.

Finally, the device according to the invention could also be used upside-down without leaving the idea and the scope of invention. Thereby, the pipe would not extend upwards but downwards into the at least one container which container would be placed underneath the container receiving portion. Simultaneously, the tangentially swirling air flow would not be directed upwards but downwards from the air inlet into the at least one container and to the air outlet portion, thereby cooling or frosting the container.

The above features and advantages of the present invention will become more apparent upon reading the following detailed description along with the accompanying drawings.

DETAILED DESCRIPTION OF THE PREFERRED EMBODIMENTS

Figure 1:
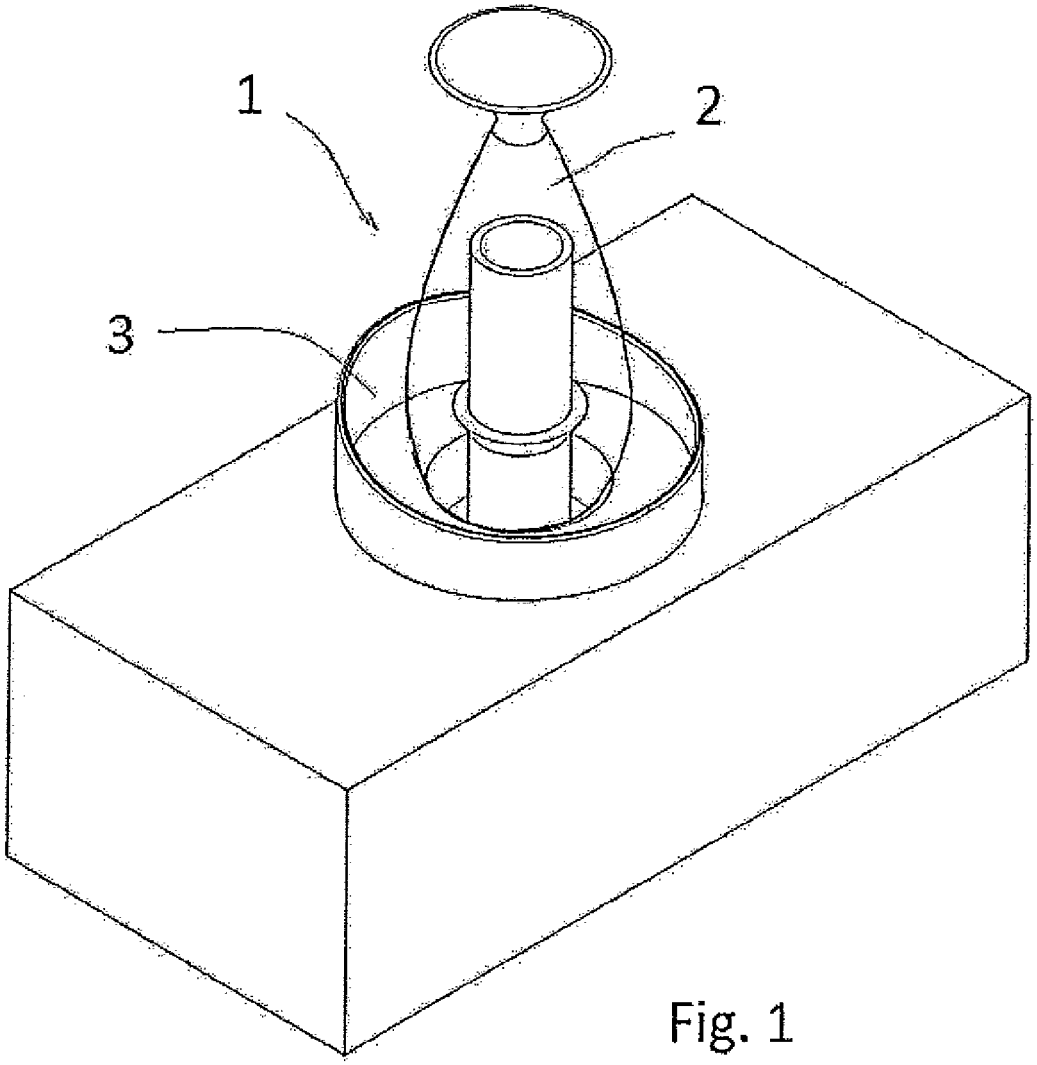
FIG. 1 is a perspective view of a device for cooling or frosting a container according to an embodiment.

FIG. 1 is a perspective view of a device 1 for cooling or frosting a container 2 according to an embodiment of the invention. The device 1 is configured as a single glass freezer and supports one container 2 to be chilled or frosted which in this case is a beer glass which is supported in the container receiving portion 3 of the device 1.

Figure 2A:
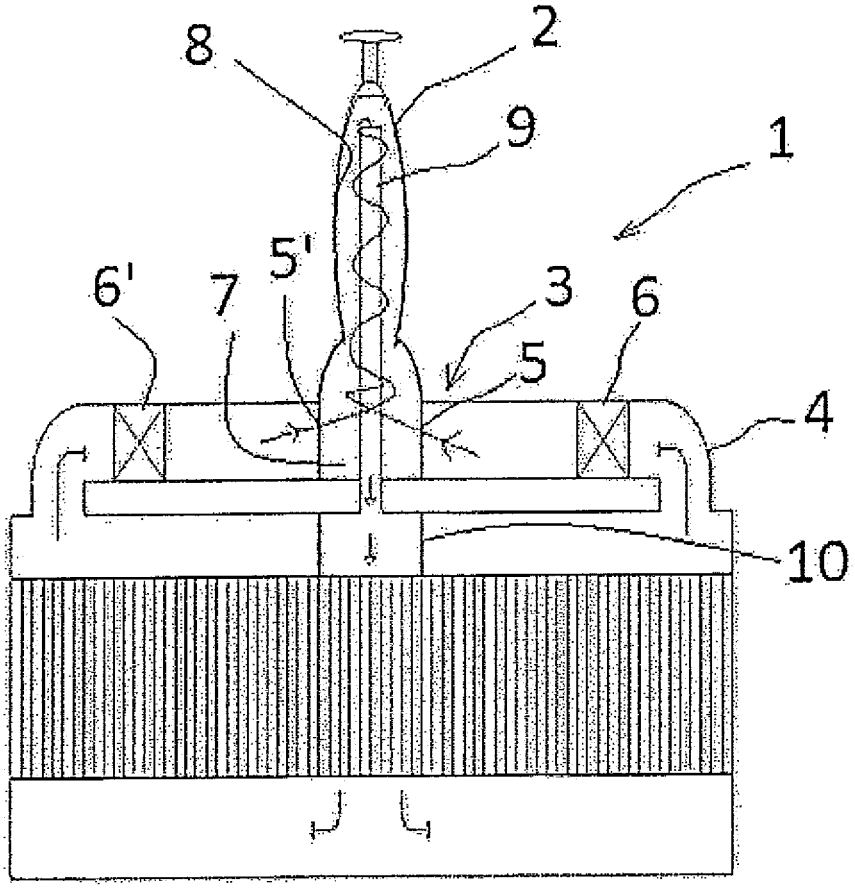
FIG. 2*a* and FIG. 2*b* are respective views of a device for cooling or frosting a container according to a further embodiment.
Figure 2B:
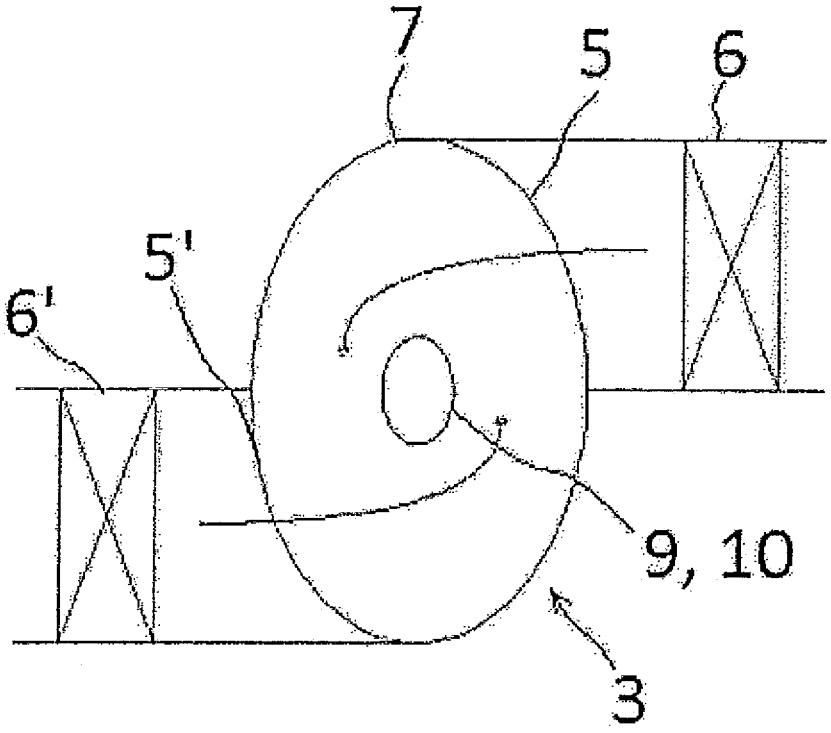

FIG. 2*a* and FIG. 2*b* are respective views of a device 1 for cooling or frosting a container 2, wherein FIG. 2*a* is a partial sectional view and FIG. 2*b* a top view on the central part of the device 1. As can be seen in FIG. 2*a* the device 1 comprises a container receiving portion 3 in its central part in which a container 2 such as a glass to be chilled can be placed upside down. The container receiving portion 3 is comprised in a base 4 and has two air inlets 5, 5' through which cold air indicated by the arrows is blown with high speed by fans 6, 6' into an annular chamber 7. In order to achieve a swirling air flow in the annular chamber 7, the air is blown into the annular chamber 7 tangentially. By the so-called Coanda effect, air will be directed on the inner surface 8 of the container 2 which has been placed in the container receiving portion 3 in a thin layer. Further, the swirling air moves upwards along the inner surface 8 of the container 2 until it reaches the bottom of the container 2 from where the air is sucked out of the container 2 into a central pipe 9 of an air outlet portion 10 of the container receiving portion 3 which pipe 9 from the container receiving portion 3 extends upwards into the container 2. The swirling air is sucked out of the container into the central pipe 6 by means of an additional support fan which is not shown here. The used air is sucked downwards through the pipe 9 of the air outlet portion 10 which is connected to a cooler block 11 via a cooler block air inlet 12 (see FIG. 3*b*).

Figure 3A:
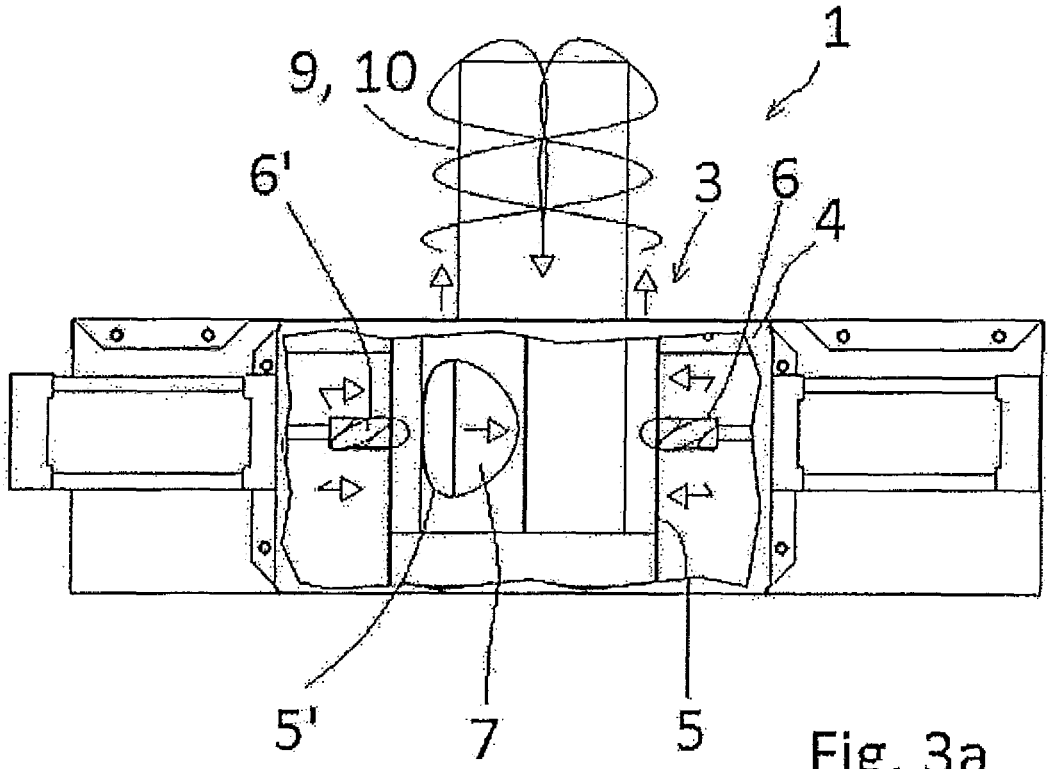
FIG. 3*a* and FIG. 3*b* are respective sectional views of a device for cooling or frosting a container according to still a further embodiment.
Figure 3B:
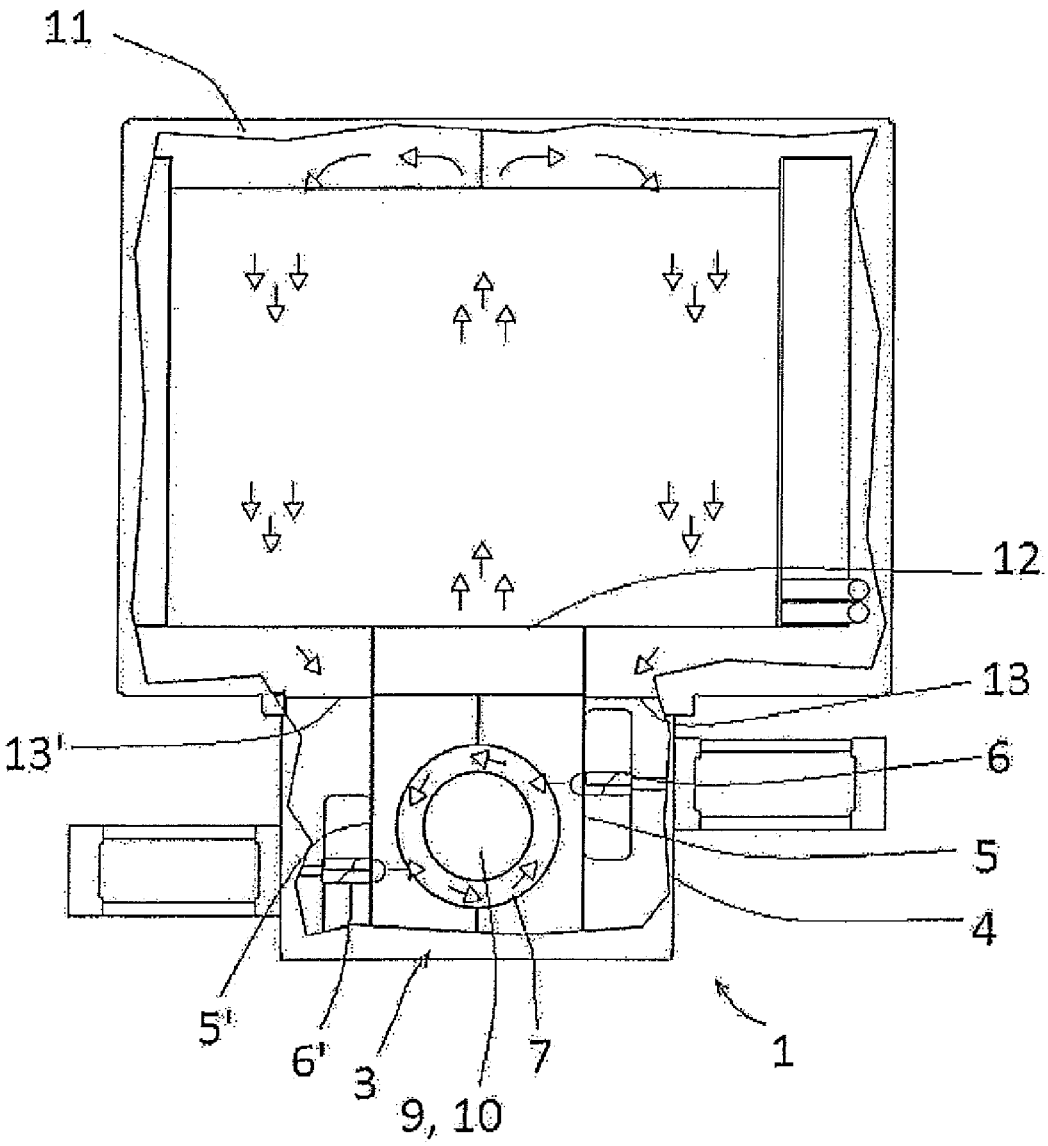

FIG. 3*a* and FIG. 3*b* are respective sectional views of a device 1 for cooling or frosting a container (not shown here) according to still a further embodiment. The device 1 is basically configured as the device 1 already described above in connection with FIG. 2*a* and FIG. 2*b*. However, as can be seen here in FIG. 3*b*, the base 4 with the container receiving portion 3 is connected to a cooler block 11 in which the air used to chill the container 2 (see FIG. 2*a*) which is still cool but slightly warmed up compared to the air introduced into the annular chamber 7 at the two air inlets 5, 5' is cooled down to an appropriate temperature again. As described above, the used air is sucked out of the container 2 through the central pipe 9 and is introduced into the cooler block 11 at its cooler block air inlet 12. From there, the air is circulated through the cooler block 11 several times by passing through several sections (only indicated here schematically by several arrows) into which the cooler block 11 is divided to achieve an efficient cooling of the air which after having passed through the entire cooler block 11 reaches a predetermined temperature at which it is reintroduced into the base 4 and the container receiving portion 3 through two cooler block air outlets 13, 13'.

Figure 4A:
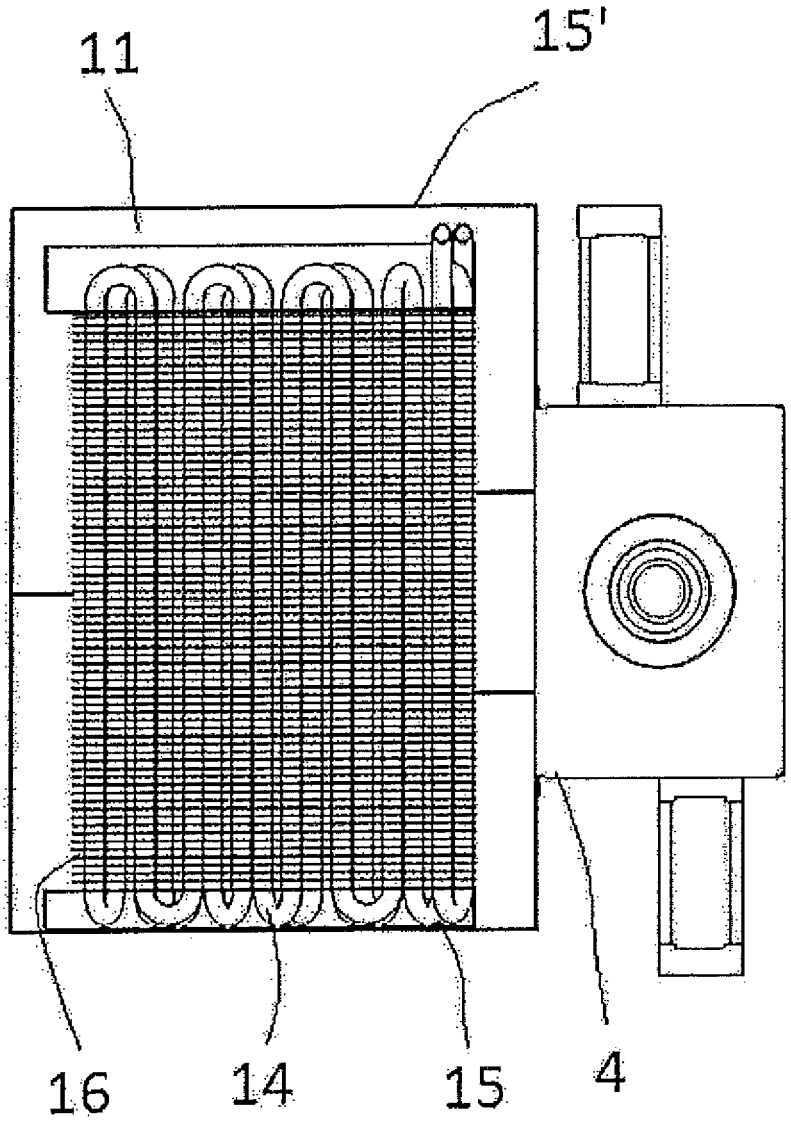
FIG. 4*a* and FIG. 4*b* are respective views of a cooler block of the device for cooling or frosting a container shown in FIG. 3*a* and FIG. 3*b*.
Figure 4B:
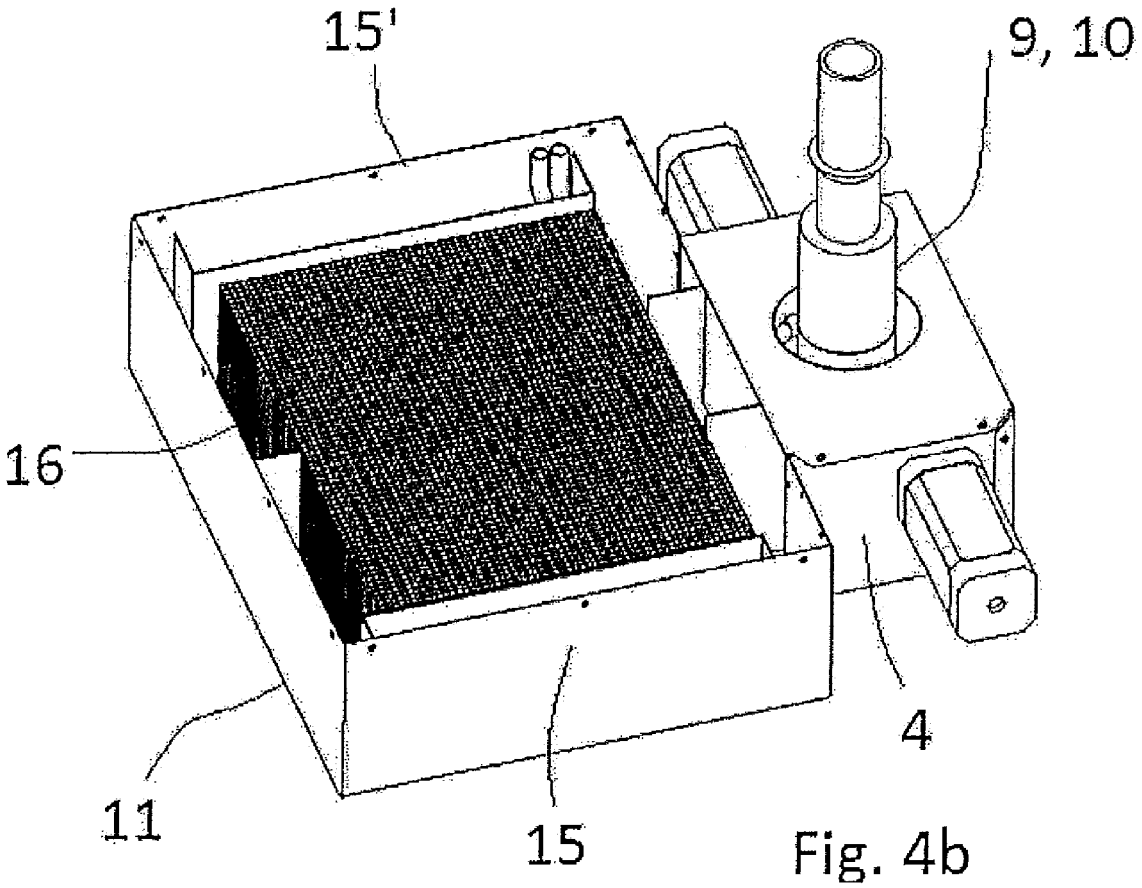
Figure 5A:
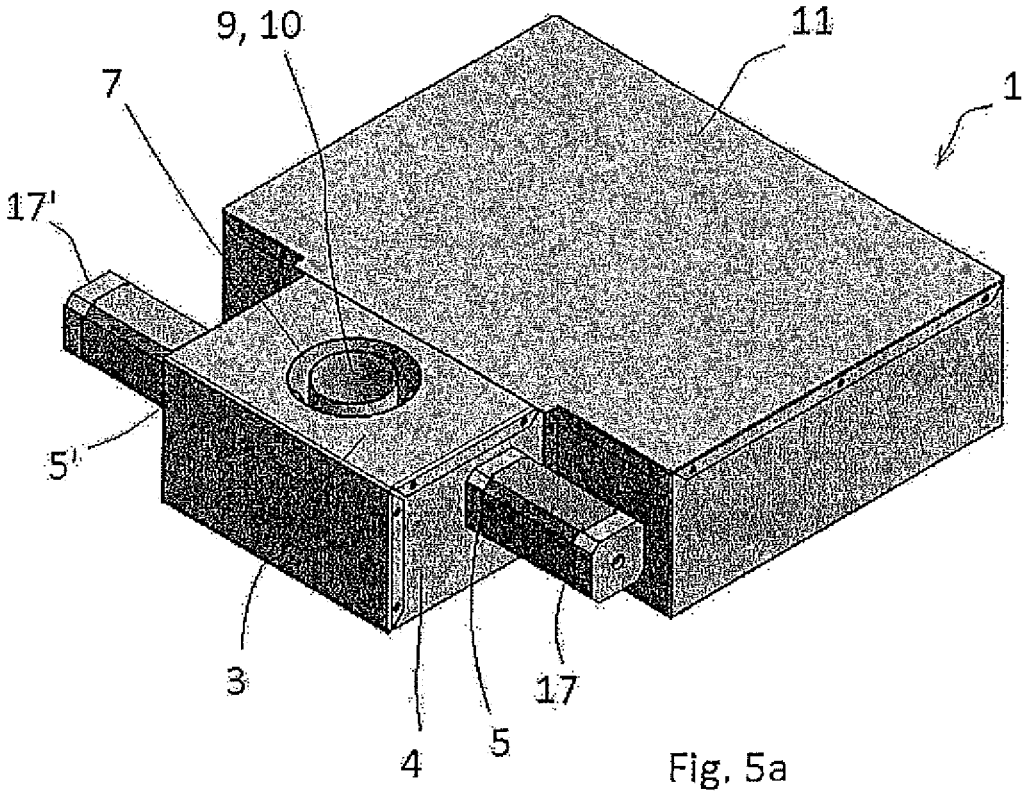
FIG. 5*a*-5*d* are respective perspective views of the device for cooling or frosting a container shown in FIG. 3*a* and FIG. 3*b*.
Figure 5B:
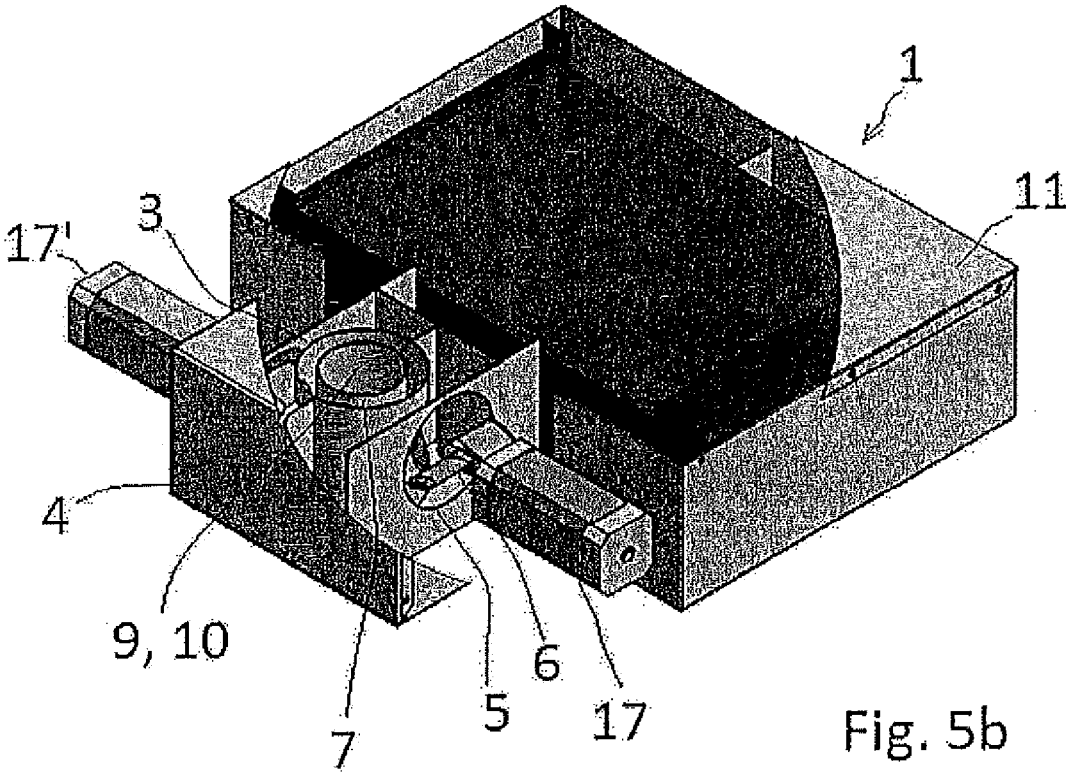
Figure 5C:
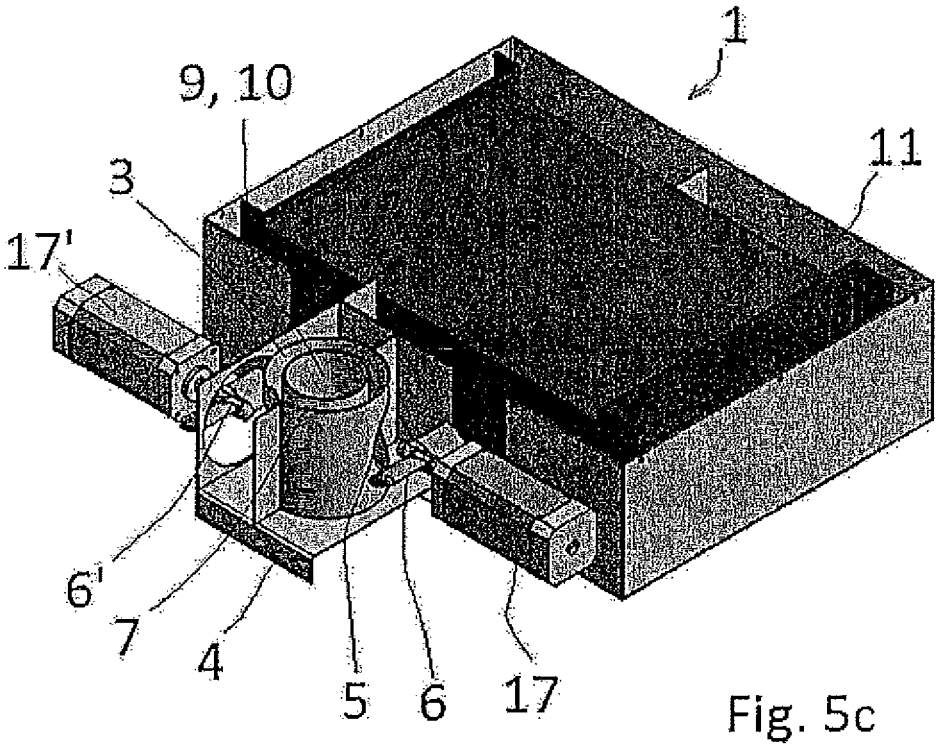
Figure 5D:
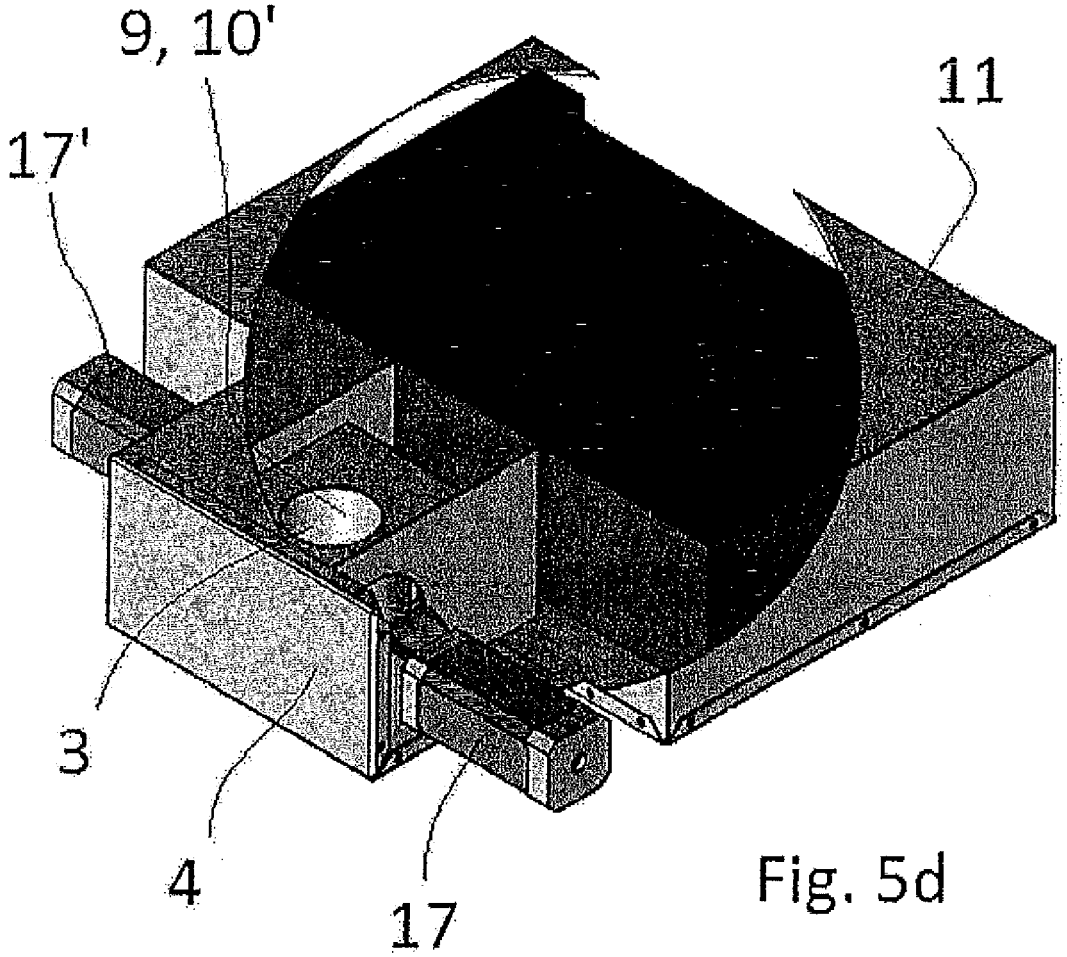

FIG. 4*a* and FIG. 4*b* are respective views of a cooler block 11 of the device 1 for cooling or frosting a container shown in FIG. 3*a* and FIG. 3*b*. As can be seen, the cooler block 11 is formed as an evaporator with a piping 14 which is arranged such that it meanders back and forth between the short sides 15, 15' of the cooler block 11 and through which a cooling liquid is circulated. A plurality of cooling ribs 16 is arranged between the piping 14 so as to make the heat transfer between the piping 14 and the air passing through the cooler block 11 more efficient. Thus, a temperature difference of at least 30° C. of the air circulated in the cooler block 11 from the cooler block air inlet 12 to the cooler block air outlets 13, 13' (see FIG. 3*b*) can be achieved.

FIGS. 5*a* to 5*d* are respective perspective views of the device 1 for cooling or frosting a container 2, as shown in FIG. 3*a* and FIG. 3*b*. As can be seen in the figures, the fans 6, 6' for blowing air with high speed into the annular chamber 7 are equipped with external engines 17, 17' to keep any heat generated by the latter during operation out of the air flow path.

REFERENCE NUMERALS

1 device for cooling or frosting a container
2 container
3 container receiving portion
4 base
5, 5' air inlets
6, 6' fans

7 annular chamber
8 inner surface of container
9 central pipe
10 air outlet portion
11 cooler block
12 cooler block air inlet
13, 13' cooler block air outlets
14 piping
15, 15' short sides of cooler block
16 cooling ribs
17, 17' external engines

The invention claimed is:

1. A device (1) for cooling or frosting at least one container (2) using cold air, the device (1) comprising a base (4) with a container receiving portion (3), at least one cold air inlet (5) and an annular chamber (7), the container receiving portion (3) includes the at least one cold air inlet (5) through which cold air is introduced into the annular chamber (7), wherein the container receiving portion (3) further comprises an air outlet portion (10) comprising a pipe (9) extending upwards into the at least one container (2), the pipe (9) being configured to suction air out of the at least one container (2), wherein the at least one cold air inlet (5) is positioned at an outer circumference of the annular chamber (7) to introduce the cold air into the annular chamber (7) tangentially, thereby generating a swirling air flow by a centrifugal force of the cold air which is led along an inner surface of the at least one container (2) placed on the container receiving portion (3), thereby cooling or frosting the container (2) to be cooled.

2. The device (1) according to claim 1, wherein the tangentially swirling air flow is generated by the cold air tangentially introduced into the annular chamber (7) and the at least one container (2) to be cooled.

3. The device (1) according to claim 1, wherein the device (1) further comprises a cooler block (11) in which the air is cooled down to a predetermined temperature, wherein the predetermined temperature is lower than −10° C.

4. The device (1) according to claim 1, wherein two of the cold air inlets (5, 5') are arranged at the outer circumference of the annular chamber (7), the two air inlets (5, 5') being positioned on opposite sides with an angle of approximately 180° therebetween.

5. The device (1) according to claim 4, wherein each of the two cold air inlets (5, 5') is equipped with a fan (6, 6') to introduce the cold air into the annular chamber (7) with high speed.

6. The device (1) according to claim 5, wherein each of the fans (6, 6') is equipped with an external engine (17, 17').

7. The device (1) according to claim 3, wherein the cooler block (11) has a cooler block air inlet (12) which is connected to the air outlet portion (10) of the container receiving portion (3), and which has at least one cooler block air outlet (13) which is connected to the at least one cold air inlet (5) of the container receiving portion (3).

8. The device (1) according to claim 7, wherein there are two of the cooler block air outlets, the air introduced from the pipe (9) into the cooler block (11) is led through the cooler block (11) along a longitudinal direction, and a temperature difference ($\Delta T$) of the air passing through the cooler block (11) from the cooler block air inlet (12) to the two cooler block air outlets (13, 13') is at least 30° C.

9. The device (1) according to claim 3, wherein the cooler block (11) is divided into multiple sections though which the air introduced from the pipe (9) is led such that the air passes through the cooler block (11) multiple times.

10. The device (1) according to claim 1, wherein the container receiving portion (3) comprises illumination means.

11. The device (1) according to claim 1, wherein the container receiving portion (3) comprises a sensor configured to detect the placement of the at least one container (2) in the container receiving portion (3).

12. The device (1) according to claim 11, wherein the detection of the at least one container (2) placed on the container receiving portion (3) triggers a start of the device (1) to cool or freeze the at least one container (2).

13. The device (1) according to claim 3, wherein the cooler block (11) comprises an evaporator which is mechanically cooled by an external cooling device or which is thermoelectrically cooled by a Peltier element.

14. The device (1) according to claim 1, wherein the device (1) is configured as at least one of an integrated device, a standalone device, a mobile device, a single glass cooler or freezer, or a multiple glass cooler or freezer.

* * * * *